US007699172B2

(12) United States Patent
McTavish et al.

(10) Patent No.: US 7,699,172 B2
(45) Date of Patent: Apr. 20, 2010

(54) STACKING DELIVERY TRAY

(75) Inventors: Gordon McTavish, Edmonton (CA); Cory Koski, Edmonton (CA); Hongqiao Li, Edmonton (CA)

(73) Assignee: Drader Manufacturing Industries Ltd., Edmonton (CA)

( * ) Notice: Subject to any disclaimer, the term of this patent is extended or adjusted under 35 U.S.C. 154(b) by 211 days.

(21) Appl. No.: 11/817,142

(22) PCT Filed: Feb. 22, 2006

(86) PCT No.: PCT/CA2006/000249

§ 371 (c)(1),
(2), (4) Date: Aug. 24, 2007

(87) PCT Pub. No.: WO2006/089407

PCT Pub. Date: Aug. 31, 2006

(65) Prior Publication Data

US 2008/0110790 A1 May 15, 2008

(30) Foreign Application Priority Data

Feb. 24, 2005 (CA) ..... 2498571

(51) Int. Cl.
*B65D 21/032* (2006.01)
*B65D 85/62* (2006.01)

(52) U.S. Cl. ..... 206/511; 206/509

(58) Field of Classification Search ..... 206/505, 206/509, 511, 512, 518
See application file for complete search history.

(56) References Cited

U.S. PATENT DOCUMENTS

| | | | |
|---|---|---|---|
| 3,387,740 | A | 6/1968 | Bockenstette |
| 3,675,815 | A | 7/1972 | Rehrig |
| 3,780,905 | A | 12/1973 | Heroizer |
| 4,000,817 | A | 1/1977 | Sanders |
| 5,035,326 | A | 7/1991 | Stahl |
| 5,287,966 | A | 2/1994 | Stahl |
| 5,881,902 | A | 3/1999 | Ackermann |
| 6,273,259 | B1 | 8/2001 | Stahl |
| 6,394,274 | B1 | 5/2002 | Cheeseman |
| 2004/0060844 | A1 | 4/2004 | Stahl |

FOREIGN PATENT DOCUMENTS

| | | |
|---|---|---|
| CA | 2276863 | 12/2005 |

*Primary Examiner*—Anthony Stashick
*Assistant Examiner*—Harry A Grosso
(74) *Attorney, Agent, or Firm*—Christensen O'Connor Johnson Kindness PLLC

(57) ABSTRACT

A two position stacking delivery tray is provided which is capable of stacking with itself, and also stacking with existing single position stacking delivery trays. A single uneven upstanding tongue is positioned along a top edge of each of a first side wall and a second side wall. The uneven upstanding tongue defines a first engagement with peaks and valleys. Tongue receivers are positioned in the bottom defining an uneven groove adapted to mate with a single upstanding tongue of an underlying tray having a single stacking product height position. The uneven groove defines a second engagement with peaks and valleys. The peaks and valleys of the first engagement and the second engagement are asymmetrically positioned, so as to provide two stacking product height positions by relative rotation of stacking trays by 180 degrees.

8 Claims, 8 Drawing Sheets

STACKING DELIVERY TRAY

FIELD OF THE INVENTION

The present invention relates to stacking delivery trays, such as are used by bakeries.

BACKGROUND OF THE INVENTION

U.S. Pat. No. 3,387,740 (Bockenstette No. 1968); U.S. Pat. No. 3,675,815 (Rehig 1972) and U.S. Pat. No. 3,780,905 (Heroizer 1973) are examples of delivery trays that have a single stacking product height position and a nesting position. U.S. Pat. No. 4,000,817 (Sanders et al 1977); U.S. Pat. No. 5,035,326 (Stahl 1991); U.S. Pat. No. 5,287,966 (Stahl 1994); U.S. Pat. No. 6,273,259 (Stahl 2001) and U.S. Pat. No. 6,394, 274 (Cheeseman 2002) are examples of delivery trays that have two stacking product height positions and a nesting position. Trays with two stacking product height positions are slowly replacing trays that have a single stacking product height position, as two stacking product height positions offer greater flexibility for production facilities. Trays with a single stacking product height position are not used with trays having two stacking product height positions, as the stacking engagements used on the trays are incompatible.

SUMMARY OF THE INVENTION

According to a preferred embodiment, there is provided a stacking delivery tray, which includes a body having a generally rectangular bottom with a first side wall and a second side wall fixed to and extending upwardly from the respective side edges of the bottom in parallel spaced relation. Parallel spaced vertical front and back walls are fixed to the remaining edges of the bottom, and their vertical edges are fixed to the neighboring vertical edges of the side walls, thereby forming with the side walls and bottom an open shallow box structure.

A single planar vertically uneven upstanding tongue is formed in or otherwise attached to a top edge of each of the first side wall and the second side wall. The upstanding tongue is adapted to engage a mating bottom groove on an overlying tray of the type known in the prior art having a single stacking product height position. The uneven upstanding tongue has a profile comprising alternating peaks and valleys asymmetrically disposed from one end of the side wall to the other. Cavities serving as tongue receivers are formed in the bottom along each of the first side wall and the second side wall. Each of the tongue receivers is bounded by an inside retainer and an outside retainer attached in parallel spaced relation along the bottom of the body to define lateral boundaries of a vertically uneven groove adapted to mate with and engage a single upstanding tongue of an underlying tray of the type known in the prior art having a single stacking product height position. Each outside retainer is coterminous with an outer face of one of the first side wall and the second side wall, thereby maintaining the same outer dimension.

The uneven groove underneath each side wall has a profile comprising alternating peaks and valleys spaced and dimensioned to mate with the profile of the uneven upstanding tongue in one relative orientation (engagement) of two such delivery trays stacked one upon the other. When the two trays are stacked in this first engagement, the respective mating profiles of the groove and the tongue enable a mating secure engagement of the two, with the peaks of the groove in register with the valleys of the tongue and vice versa, providing a first vertical space (product height) between the bottom of the lower tray and the bottom of the upper tray that is the a lower stacking height.

Because the peaks and valleys of both the tongue and groove are asymmetrically positioned, the upper tray in a stacked pair may be rotated 180 degrees in a horizontal plane to reverse its orientation relative to that of the lower tray, thereby enabling a second engagement between the groove and tongue. In this second engagement, the peaks of the tongue are out of register with the valleys of the groove and vice versa, resulting in the peaks of the tongue abutting the peaks of the groove to provide a second (maximum) stacking product height position between the two trays.

A stackable delivery tray in accordance with the present application has a number of characteristics in common with previously known stackable single-product-height trays, but differs therefrom in having a structure described below that enables the spacing between any two trays in the stack to be varied between a higher stacking height and a lower stacking height. Further, a stackable delivery tray in accordance with preferred embodiments described herein differs from previously known stackable dual-product height trays in providing stacking compatibility with previously known single-product-height trays.

In accordance with at least one preferred embodiment, a stackable delivery tray includes the following characteristics:

each side wall is provided with an upper and a lower profile extending generally from the front wall to the back wall;

each profile comprises a series of peaks and valleys, the peaks of the lower profile being vertically inverse to the peaks of the upper profile for most of the length of the lower profile, and the valleys of the lower profile being vertically inverse to the valleys of the upper profile for most of the length of the lower profile (in other words, the peaks of the lower profile project downward, and the valleys of the lower profile extend upward from the peaks);

the series of peaks and valleys of each profile is asymmetric from the front wall to the back wall; desirably, the profiles on one side wall are the virtually mirror image (in a horizontal sense) of those on the other side wall, as viewed face-on from outside the side walls;

the profiles of one of the side walls are opposite in left-to-right orientation (as viewed face-on from the outside of such side wall) from the orientation of the profiles of the other of the side walls, and preferably the upper profiles of the two side walls are mirror images of one another about a vertical axis, as viewed face-on from the outside; and equally the lower profiles of the two side walls are mirror images of one another about a vertical axis, as viewed face-on from the outside;

in a first stacking engagement of the delivery tray with a like tray, the peaks of the upper profile of the delivery tray mate with and engage the valleys of the lower profile of the like tray, and the valleys of the upper profile of the delivery tray mate with and engage the peaks of the lower profile of the like tray (using "mate" in a broad sense to include a peak that is shorter and/or narrower in dimension than the dimensions of the valley into which it is to protrude); and in a second stacking engagement of the delivery tray with a like tray, the peaks of the upper profile of the delivery tray abut the peaks of the lower profile of the like tray.

The foregoing characteristics enable any two such like trays to be stacked so as to provide a lesser spacing between the bottoms of the stacked trays in the first engagement, and a greater spacing between the bottoms of the two trays in the second engagement.

Preferred delivery trays in accordance with the present application stack not only with like trays but also with prior-art single-product-height trays whose bottoms have the same or similar dimensions. To this end, the uppermost surfaces of the side walls of delivery trays as described above are provided with uppermost projecting portions, and the side walls are provided with lowermost fitting surfaces mating with, and, in the aforesaid stacking engagements, engaging the uppermost projecting portions of a like tray stacked underneath. The aforesaid structural characteristics facilitate stacking of the delivery tray with its like or with a similar single-product-height tray lacking such profiles but having counterpart uppermost projecting surfaces and lowermost fitting surfaces. The foregoing stacking fit should highly preferably be possible in either orientation of the upper tray in the stack relative to the orientation of the lower tray in the stack, and this is readily accomplished by having the designs of the uppermost projecting portions and lowermost fitting surfaces identical or nearly so for each side wall of the tray.

In a preferred embodiment, the uppermost projecting portion is a tongue or rib, and the lowermost fitting surface is that of the interior of a groove. Optionally, the tongue may embody the upper profile, in which case it is a tongue of uneven height, and the groove may embody the lower profile, in which case the groove is of uneven depth. The tongue should mate with the groove, again using the term "mate" in a liberal sense, implying that the peaks in the upper profile should comfortably be able to enter the corresponding valleys in the groove's lower profile, and the peaks in the lower profile should comfortably be able to enter the corresponding valleys in the upper profile, so that there is a suitable fit one with the other, but not necessarily close dimensional correspondence between "mating" peaks and valleys. Preferably the peaks and valleys of each of the profiles constitute a continuum from the front wall to the back wall. Preferably the top surfaces of the peaks are generally horizontal, and of substantially uniform height relative to the valleys, so that in the second stacking engagement, abutment of peaks of the upper and lower profiles will be uniform across a series of horizontal surfaces defined by the overlapping portions of peaks in the upper and lower profiles. The inset surfaces of the valleys may desirably be generally horizontal, but this is not critical as long as the valleys can comfortably receive the "mating" peaks. However, designing the shape and dimensions of the valleys to conform (with the usual loose-fit tolerances) with that of their mating peaks promotes a stable fit of vertically adjacent trays in the first stacking engagement. Given the desirability of a balanced distribution of the weight of the trays in a stack and the avoidance of highly loaded pressure points that might unbalance the weight distribution, the peaks are desirably spaced so that abutment of the peaks of the upper and lower profiles in the second stacking engagement includes abutment on both sides of the horizontal center of the side walls (as viewed face-on from the outside).

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
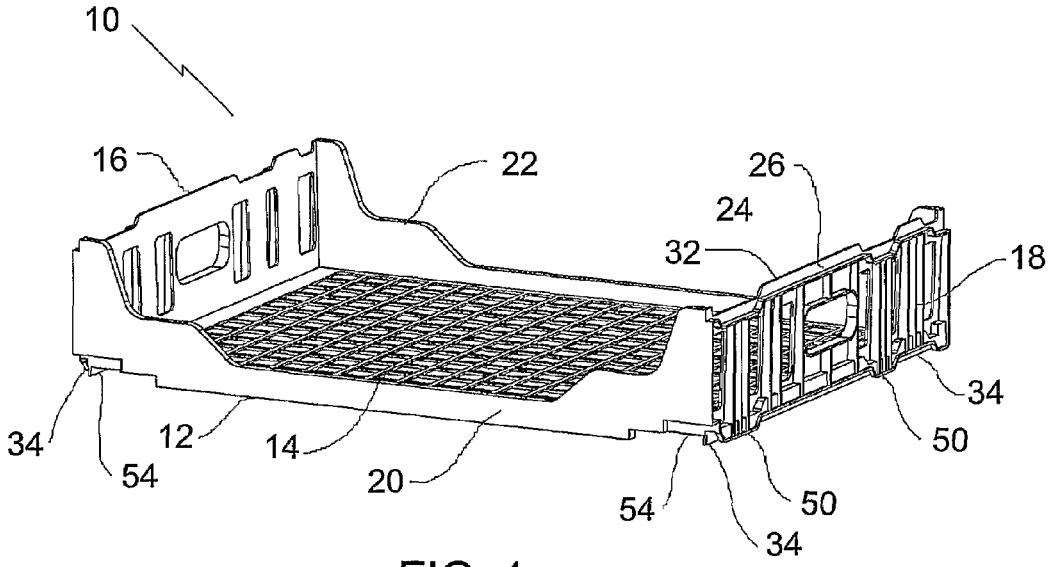
FIG. 1 is a perspective view of a stacking delivery tray constructed in accordance with the teachings of the present invention.

The preferred embodiment, a stacking delivery tray generally identified by reference numeral 10, will now be described with reference to FIGS. 1 through 16.

Figure 2:
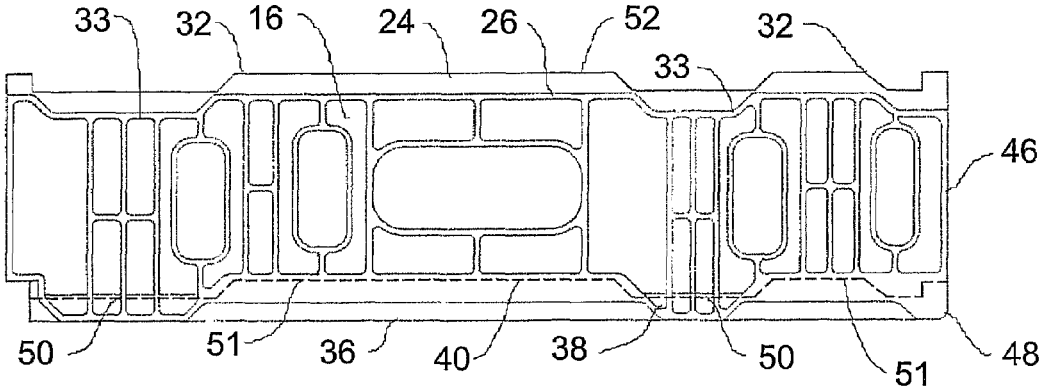
FIG. 2 is a side elevation view of the stacking delivery tray in FIG. 1.
Figure 3:
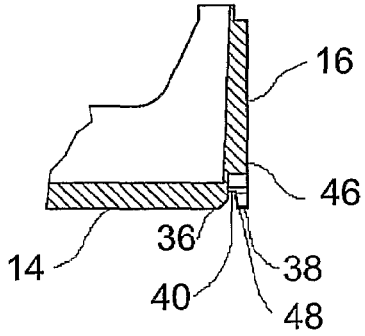
FIG. 3 is a side elevation view in section of a side wall.
Figure 4:
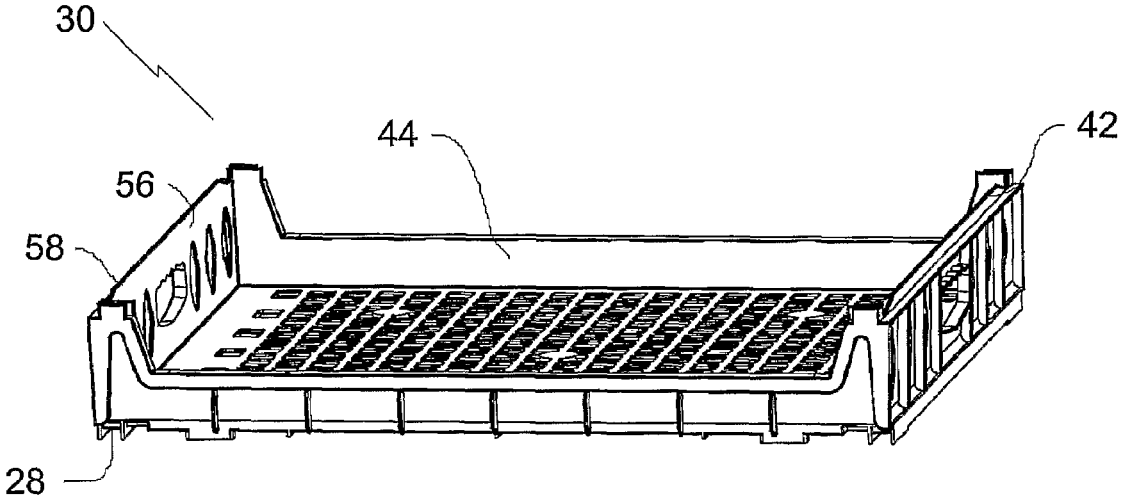
FIG. 4 (PRIOR ART)
FIG. 4 is a perspective view of a delivery tray in the prior art.
Figure 5:
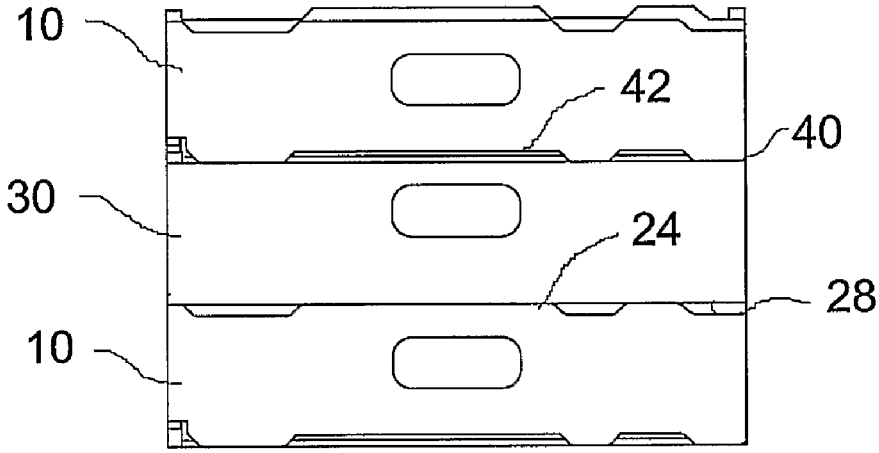
FIG. 5 is a side elevation view of a stack of trays constructed in accordance with the teachings of the present invention stacked with a prior art tray.
Figure 6:
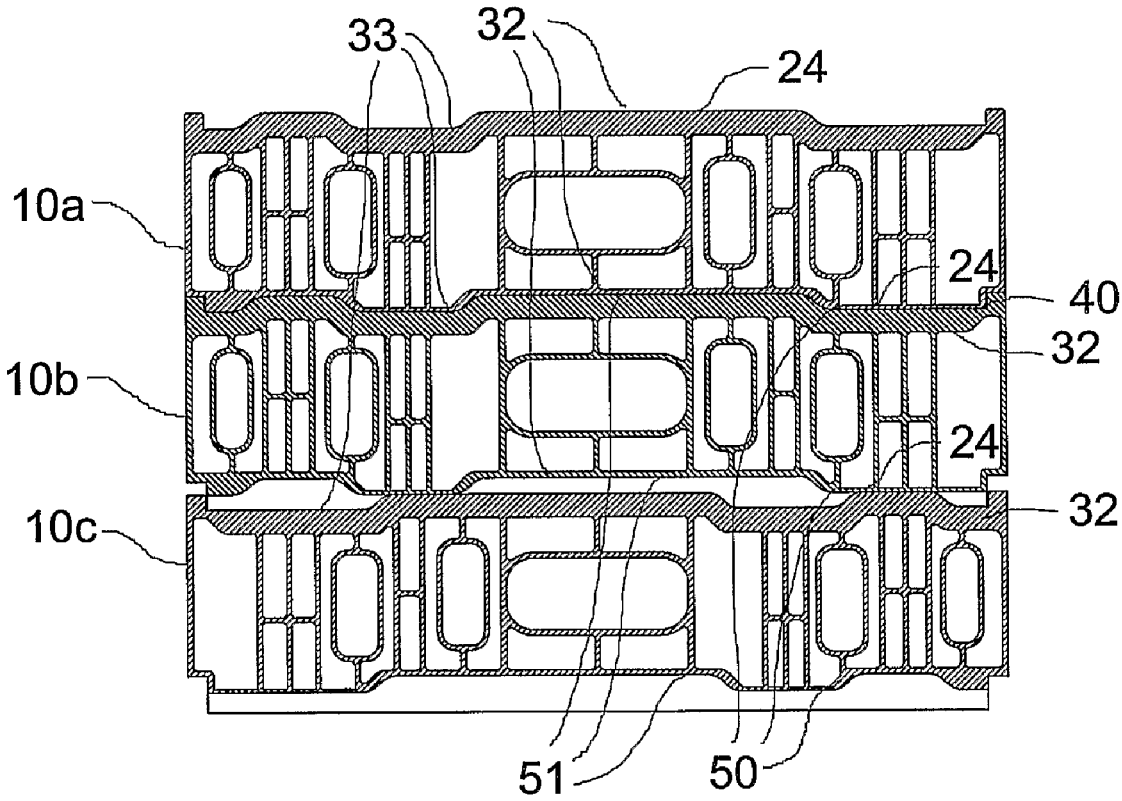
FIG. 6 is a side elevation view, in section, of a stack of trays, all of which are constructed in accordance with the teachings of the present invention.
Figure 7:
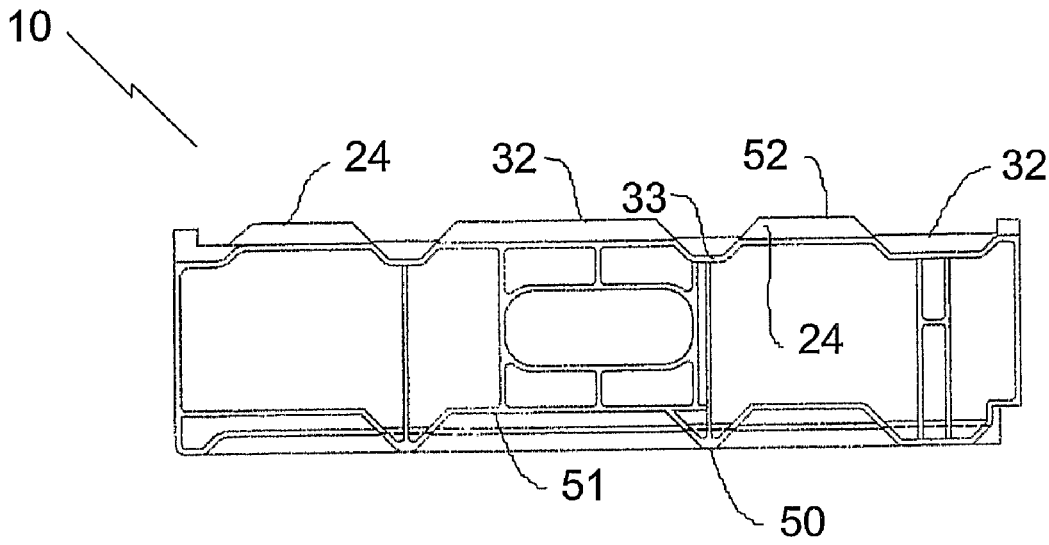
FIG. 7 is a side elevation view of a variation of the stacking delivery tray in FIG. 1.

Structure and Relationship of Parts:

Referring now to FIG. 1, there is shown stacking delivery tray 10, including a body 12 that has a bottom 14 with a first side wall 16 and a second side wall 18 extending upwardly from bottom 14 in parallel spaced relation. Body 12 also has a front wall 20 and a back wall 22. Referring to FIG. 2, there is a single planar vertically uneven upstanding tongue 24 positioned along a top edge 26 of each of first side wall 16 and second side wall 18. Single uneven upstanding tongue 24 is adapted to mate with a bottom groove 28 on a tray 30 that has a single stacking product height position when it is overlying stacking delivery tray 10. Tray 30 and bottom groove 28 are shown in FIG. 4 labeled prior art. Referring again to FIG. 2, uneven upstanding tongue 24 defines a first engagement with peaks 32 and valleys 33. Referring to FIG. 1, tongue receivers 34 are positioned in bottom 14 along each of first side wall 16 and second side wall 18. Referring to FIG. 3, each tongue receiver 34 includes an inside retainer 36 and an outside retainer 38 positioned in parallel spaced relation along bottom 14 of body 12 to define lateral boundaries of a vertically uneven groove 40. The profile of uneven groove 40 is shown in dotted lines in FIG. 2 and is shown in the section view of FIG. 6. Referring to FIG. 4, uneven groove 40 is adapted to mate with a single upstanding tongue 42 of tray 30 when it is underlying stacking delivery tray 10. Referring to FIG. 5, tray 30 is shown with a stacking delivery tray 10 positioned above and below, with single uneven upstanding tongue 24 engaging a bottom groove 28 and uneven groove 40 engaging single upstanding tongue 42. Referring to FIG. 6, the trays have been labeled 10*a*, 10*b*, and 10*c* to differentiate between their relative positions. Uneven groove 40 defines a second engagement with peaks 50 and valleys 51 adapted to engage peaks 32 and valleys 33 of the first engagement on uneven upstanding tongue 24. Peaks 32 and valleys 33 of the first engagement and peaks 50 and valleys 51 of the second engagement 50 are asymmetrically positioned. When two trays 10 are in one relative orientation, peaks 32 of the first engagement 32 are in register with valleys 51 of the second engagement, to provide a first stacking product height position. This position is demonstrated by trays 10*a* and 10*b* of FIG. 6. When the relative orientation of the trays 10 is changed by 180 degrees, peaks 32 of the first engagement are out of register with valleys 51 of the second engagement resulting in the peaks 32 of the first engagement engaging the peaks 50 of the second engagement to provide a second stacking product height position. This position is demonstrated by trays 10*b* and 10*c* of FIG. 6.

Figure 9:
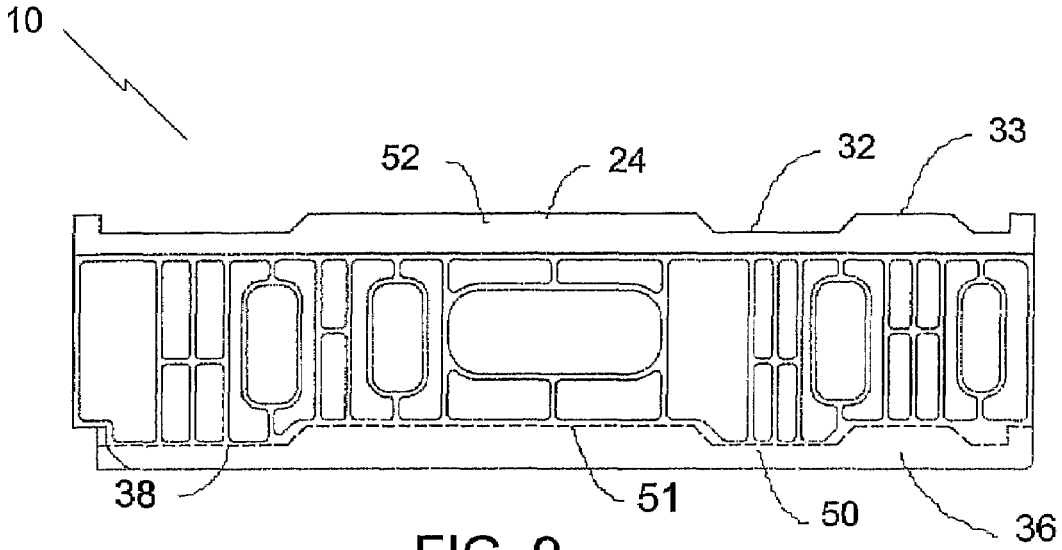
FIG. 9 is a side elevation view of a variation of the stacking delivery tray in FIG. 1.
Figure 10:
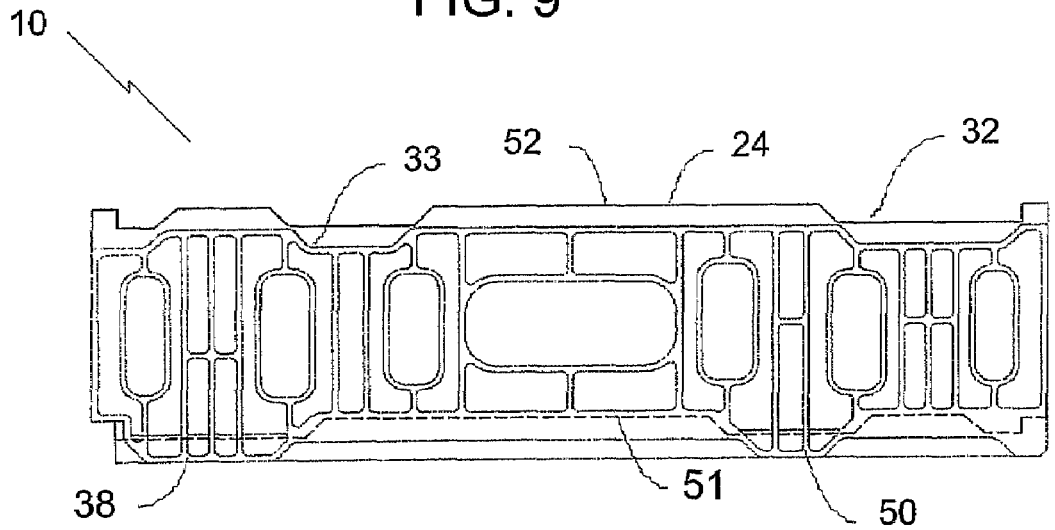
FIG. 10 is a side elevation view of a variation of the stacking delivery tray in FIG. 1.
Figure 12:
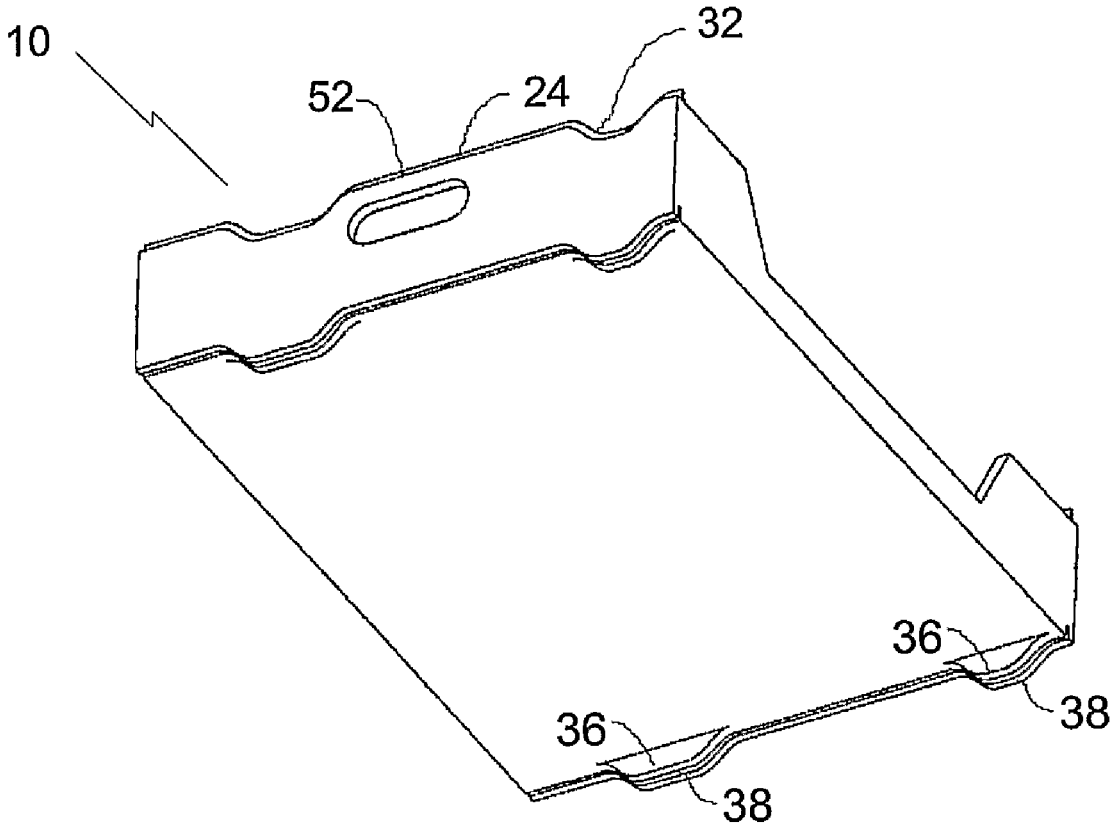
FIG. 12 is a side perspective view of a variation of the stacking delivery tray in FIG. 1.

Referring to FIG. 3, each outside retainer 38 is co-terminus with an outer face 46 of one of first side wall 16 and second side wall 18, thereby maintaining the same outer dimension. In this particular embodiment, outside retainer 38 has a remote end 48 which is co-terminus with bottom 14; although as will be seen with subsequent embodiments this need not be the case. As shown in FIG. 9, outside retainer 38 need not extend down the same distance as inside retainer 36. As shown in FIG. 12, both inside retainer 36 and outside retainer 38 may extend below bottom 14.

Figure 8:
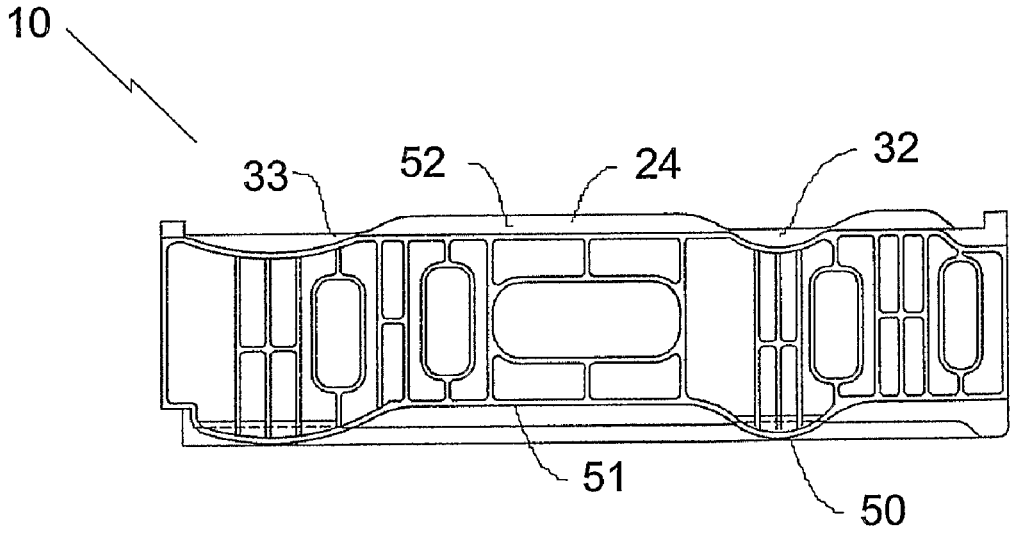
FIG. 8 is a side elevation view of a variation of the stacking delivery tray in FIG. 1.
Figure 11:
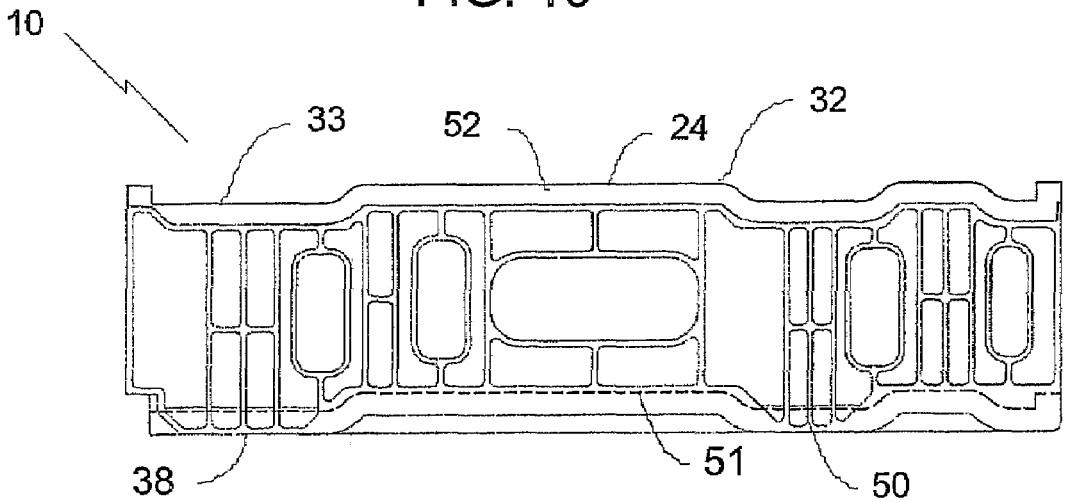
FIG. 11 is a side elevation view of a variation of the stacking delivery tray in FIG. 1.

The actual profile of the peaks and the valleys is not of critical importance. As shown in FIG. 2, peaks 32 and valleys 33 can be symmetrically tapered. As shown in FIG. 8, peaks 32 and valleys 33 can be rounded. As shown in FIG. 11, peaks 32 and valleys 33 can be tapered with radiused corners. The number and spacing of peaks and valleys is not of critical importance, as long as the mating relationship is maintained. As shown in FIG. 7 through 11, the number and configuration of peaks 32 and valleys 33 may be varied. In the illustrated embodiments side wall 16 and the first engagement profile and the second engagement profile will be a mirror image of side wall 18. This is convenient for purposes of manufacture, but is not essential, as long as the mating can take place.

Figure 13:
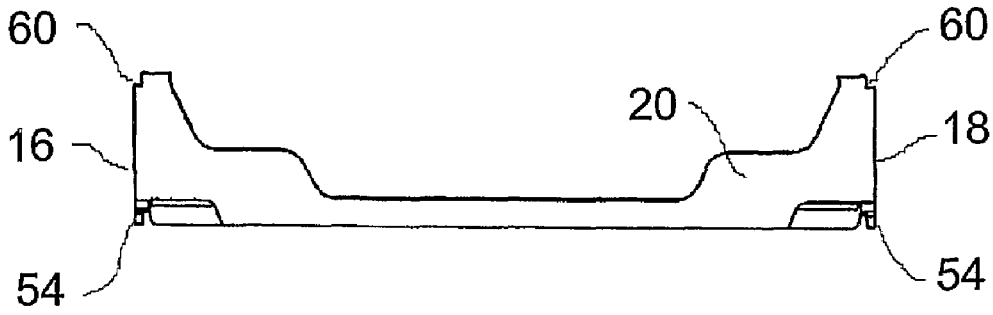
FIG. 13 is an end elevation view of the stacking delivery tray in FIG. 1.
Figure 14:
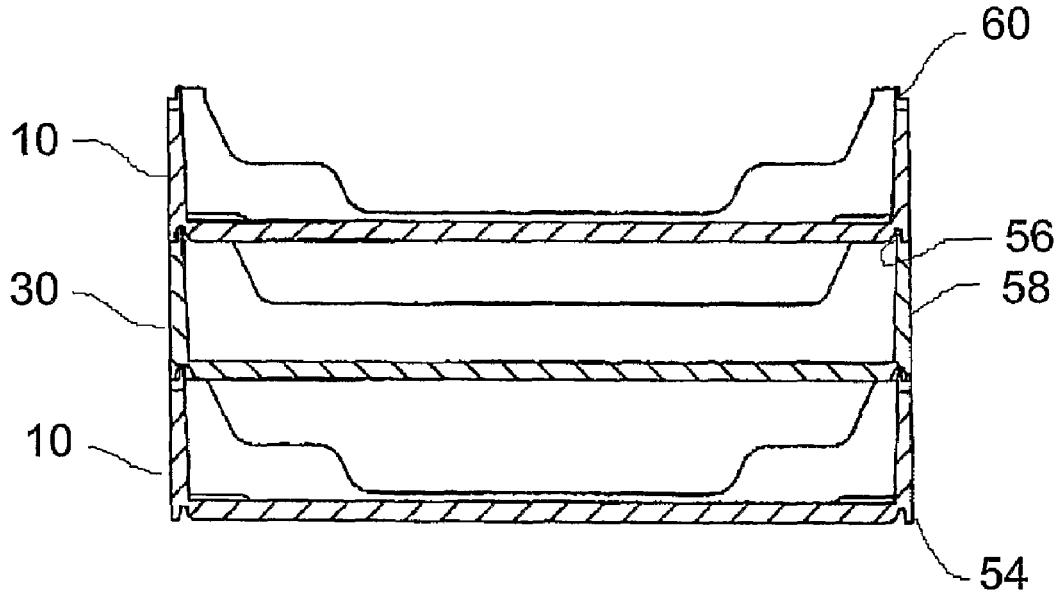
FIG. 14 is an end elevation view of a stack of trays, constructed in accordance with the teachings of the present invention stacked with a prior art tray.
Figure 15:
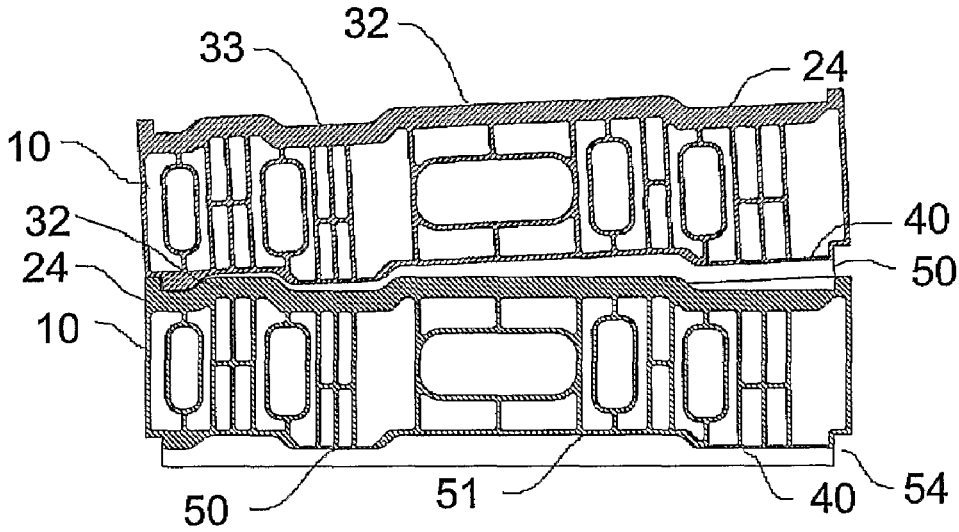
FIG. 15 is a side elevation view of two trays in a position to slide relative to each other.
Figure 16:
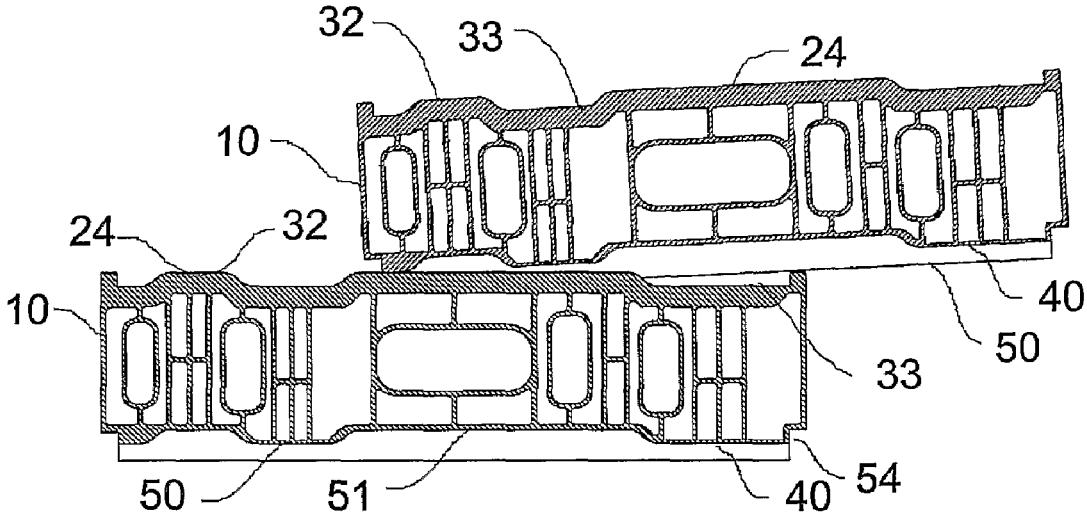
FIG. 16 is a side elevation view of two trays sliding relative to each other.

Referring now to FIGS. 1 and 13, first side wall 16 and second side wall 18 each have bottom contact shoulders 54 positioned adjacent to front wall 20 and back wall 22. Referring to FIG. 14, bottom contact shoulders 54 are adapted to engage an inner face 56 of a side wall 58 of tray 30. Referring again to FIG. 13 first side wall 16 and second side wall 18 each have upper contact shoulder receptacles 60 adapted to receive bottom contact shoulders 54 of an overlying tray. Referring now to FIGS. 15 and 16, when trays are stacked or removed, it is preferred that top tray 10 be lifted at an angle to bottom tray 10 as shown, to release the locking action of shoulders 54. FIG. 15 shows trays 10 at a sufficient angle to be removed, and FIG. 16 shows top tray 10 sliding along bottom tray 10.

Operation:

The use of stacking delivery tray 10 will now be discussed with reference to FIGS. 1 through 16. Referring to FIGS. 1 through 3, stacking delivery trays 10 as described above are provided for use. It is expected that trays 30 with only one stacking product height position that are commonly used in the industry will also be present. Referring to FIG. 5, if stacking delivery trays 10 are used with trays 30, single uneven tongue 24 is adapted to mate with bottom groove 28 on tray 30, and uneven groove 40 is adapted to mate with single upstanding tongue 42 of tray 30. Since both trays 10 and 30 may be used together, an inventory of trays 30 may gradually be replaced with stacking delivery trays 10. Referring to FIGS. 15 and 16, when contact shoulder 54 is engaged, trays 10 are precluded from moving forward or backward. However, when trays 10 are tilted to release contact shoulder 54, trays 10 may be freely slid onto and off of each other at an angle. Tray 10 will slide equally well with prior art tray 30, as with another tray 10. Referring to FIG. 6, stacking delivery trays 10 may be stacking using two different stacking product height positions. For the purpose of differentiation the trays have been identified as 10*a*, 10*b*, 10*c*. The first position is obtained by engaging uneven upstanding tongue 24 of tray 10*b* with uneven groove 40 of tray 10*a*. In this position, peaks 32 of the first engagement of tray 10*b* are in register with valleys 51 of the second engagement of tray 10*a*. This provides a relatively low stacking product height position. The second position is obtained by changing the orientation of the trays by 180 degrees. Uneven upstanding tongue 24 of tray 10*c* engages uneven groove 40 of tray 10*b*, as with the engagement between trays 10*a* and 10*b*. However, in this orientation valleys 51 of the second engagement of tray 10*b* are out of register with peaks 32 of the first engagement of tray 10*b*, resulting in peaks 32 of the first engagement of tray 10*c* engaging the peals 50 of the second engagement of tray 10*b*. This results in a relatively higher stacking product height position. The lower stack is convenient for stacking and transporting shorter goods, such as buns, rolls, cakes, etc. The higher stack is more convenient for stacking taller goods, such as bread.

In the present application, bakery goods have been used as examples only. It will be apparent to one skilled in the art that the delivery trays may be used with an infinite variety of products. It is important to note that the present invention can stack with trays having a single stacking product height position, while maintaining the same outer dimensions and the same inner dimensions. This is extremely important. If there were a difference in outer dimensions, it would require automated handling equipment that was capable of handling differing outer dimensions. It could also result in the need for a complete change over of equipment. The outer dimensions of the trays are chosen to fit standard shipping containers. If the engagement were to result in an increased outer dimension, they would no longer fit as intended within the shipping containers. If there were a difference in inner dimensions it would require changes to the product to fit within the smaller of the two inner dimensions.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A delivery tray comprising:

a generally rectangular bottom; and front, back, and side walls integral with or fixed to the bottom and having uppermost and lowermost configuration and dimensions such that the delivery tray is stackable with a like tray having uppermost and lowermost configuration and dimensions mating with the lowermost and uppermost configuration and dimensions, respectively, of the delivery tray, wherein:

each side wall is provided with an upper and a lower profile;

each profile comprises an undulating series of peaks and valleys, the peaks of the lower profile being vertically inverse to the peaks of the upper profile for most of the length of the lower profile, and the valleys of the lower profile being vertically inverse to the valleys of the upper profile for most of the length of the lower profile;

the sequence of peaks and valleys in the series of each profile is asymmetric from the front wall to the back wall; and a portion of each side wall serves as a sliding surface for an overlying tray during stacking;

wherein, in a first stacking engagement of the delivery tray with a like tray, the peaks of the upper profile of the delivery tray mate with and engage the valleys of the lower profile of the like tray, and the valleys of the upper profile of the delivery tray mate with and engage the peaks of the lower profile of the like tray;

wherein, in a second stacking engagement of the delivery tray with a like tray, the peaks of the upper profile of the delivery tray abut the peaks of the lower profile of the like tray;

a lesser spacing thereby being provided between the bottoms of the delivery tray and the like tray in the first engagement, and a greater spacing thereby being provided between the bottoms of the delivery tray and the like tray in the second engagement;

wherein the uppermost surfaces of the side walls are provided with uppermost projecting single tongues positioned on the same vertical plane as the single tongue of a single product height tray of like size, and the lowermost surfaces of the side walls are provided with lowermost fitting grooves mating with, and, in the stacking engagements, engaging the uppermost projecting tongues of a like tray stacked underneath, thereby facilitating stacking of the delivery tray with the like tray or with a similar stacked single-product-height tray lacking the profiles but having counterpart uppermost projecting tongues and lowermost fitting grooves, in either orientation of the upper tray in the stack relative to the orientation of the lower tray in the stack, the tongues maintaining engagement with the grooves in both the first stacking engagement and the second stacking engagement, the tongues serving as the sliding surface; and wherein stop means are provided to lock the delivery tray and the like tray or the similar stacked single-product tray in a selected one of the first stacking engagement or the second stacking engagement.

2. The delivery tray of claim 1, wherein the peaks and valleys of each of the profiles constitute a continuum from the front wall to the back wall, and the top surfaces of the peaks are generally horizontal.

3. The delivery tray of claim 2, wherein the inset surfaces of the valleys are generally horizontal.

4. The delivery tray of claim 2, wherein the peaks are of substantially uniform height relative to the valleys.

5. The delivery tray of claim 1, wherein the upper profiles of the two side walls are mirror images of one another about a vertical axis, as viewed face-on from the outside.

6. The delivery tray of claim 5, wherein the lower profiles of the two side walls are mirror images of one another about a vertical axis, as viewed face-on from the outside.

7. The delivery tray of claim 1, wherein the valleys are radiused.

8. The delivery tray of claim 1, wherein each of the side walls has bottom contact shoulders positioned adjacent to the front wall and the back wall, the bottom contact shoulders being adapted to engage an inner face of a side wall of an underlying tray having a single stacking product height position, and each of the side walls having upper contact shoulder receptacles adapted to receive the bottom contact shoulders of an underlying tray.

* * * * *